US005983901A

United States Patent [19]

Luke et al.

[11] Patent Number: 5,983,901

[45] **Date of Patent: *Nov. 16, 1999**

[54] SMOKING ARTICLES

[75] Inventors: John Anthony Luke; Philip John Kinnard, both of Southampton, United Kingdom

[73] Assignee: British-American Tobacco Company Limited, Middlesex, United Kingdom

[ * ] Notice: This patent is subject to a terminal disclaimer.

[21] Appl. No.: 08/905,580

[22] Filed: Aug. 4, 1997

Related U.S. Application Data

[63] Continuation of application No. 08/502,286, Jul. 13, 1995, Pat. No. 5,722,432, which is a continuation-in-part of application No. 08/245,815, May 18, 1994, Pat. No. 5,433,224, which is a continuation of application No. 07/826,625, Jan. 28, 1992, abandoned.

[30] Foreign Application Priority Data

Feb. 9, 1990 [GB] United Kingdom ..... 9102658

[51] Int. Cl.[6] ..... A24D 1/10

[52] U.S. Cl. ..... 131/349; 131/351; 131/360

[58] Field of Search ..... 131/360, 351, 131/364, 349, 359

[56] References Cited

U.S. PATENT DOCUMENTS

| | | | |
|---|---|---|---|
| 5,105,835 | 4/1992 | Drewett et al. | 131/349 |
| 5,433,224 | 7/1995 | Luke et al. | 131/360 |
| 5,722,432 | 3/1998 | Luke et al. | 131/349 |

*Primary Examiner*—John G. Weiss
*Assistant Examiner*—Charles W. Anderson
*Attorney, Agent, or Firm*—Kane, Dalsimer, Sullivan and Levy, LLP

[57] ABSTRACT

This invention provides a smoking article having reduced sidestream smoke in the inter-puff period. A smoking article according to the invention may comprise a lengthwise, axially extending, tobacco-containing or non-tobacco fuse portion which sustains smoulder in the inter-puff period when surrounding tobacco material is substantially extinguished and which re-ignites the extinguished material on puffing of the smoking articles.

12 Claims, 2 Drawing Sheets

SMOKING ARTICLES

This is a continuation, of copending application under 37 CFR 1.60, of pending prior application Ser. No. 08/502,286 filed Jul. 13, 1995 now U.S. Pat No. 5,722,432 which in turn, is a Continuation-In-Part of Ser. No. 08/245,815 filed May 18, 1994 (now U.S. Pat. No. 5,433,224) which is a Continuation of U.S. patent application Ser. No. 07/826,625 filed Jan. 28, 1992, now abandoned.

BACKGROUND OF THE INVENTION

1. Field of the Invention

This invention relates to smoking articles, such as cigarettes, for example, and methods of producing such articles.

2. Brief Description of the Related Art

The reduction of sidestream smoke produced by smoking articles has been a recent objective in the tobacco industry. Conventional methods thus far have centred on the identification and addition of sidestream reducing compounds either into the paper structure at the paper making stage or by coating of water-soluble sidestream reducing compounds onto the paper after manufacture; for example U.K. Patent Specification No. 2 139 869. The use of paper filler substances, such as magnesium oxide, in combination with low levels of alkali metal salts have also been proposed in U.S. Pat. No. 4,231,377. A more recent development has been the achievement of reduced sidestream smoke deliveries by providing a cigarette with a circumference within a range of 10 mm to 19 mm, a free burn rate of 25 mg $min^{-1}$ to 50 mg $min^{-1}$, and a tobacco packing density of 150 mg $cm^{-3}$ to 350 mg $cm^{-3}$ as has been disclosed in U.K. Patent Specification No. 2 175 789B.

In the past, cigarettes have been proposed having an inner core or filament surrounded by a layer of tobacco material. British Patent Specification No. 2 070 409 discloses a lengthwise extending filament which may be of an expanded reconstituted tobacco material treated with smoke-modifying agent. British Patent Specification No. 2 119 628 discloses a lengthwise extending line of expandable tobacco paste within a rod of cut tobacco material. The rod is heated and the tobacco line expands, compressing the tobacco thereabout. Lower density packing levels of the annulus of conventional tobacco material can thus be obtained.

French Patent Specification No. 998.556 discloses an inner core consisting of low quality tobacco and an annular layer of higher quality tobacco than the core. Savings in material costs are said to be achieved from such an arrangement. Further embodiments of coaxial cigarettes are described in French Patent Specification No. 1.322.254 and U.S. Pat. Nos. 1,829,559 and 4,716,913.

Cigarettes having a wrapped core are also known from U.S. Pat. No. 3,190,287, which relates to providing a by-pass arrangement in the smoking material rod for the mainstream smoke, and British Patent Specification No. 1 228 747, which relates to the selective filtration of polycyclic hydrocarbons from the mainstream smoke.

None of these documents deal with the concept of reducing sidestream smoke components of a combustible smoking article.

More recently, German Patent Application No. P38 36 210 disclosed a coaxial plain cigarette having an inner core of predominantly residue-free smoulderable material, especially tobacco, with a wrapper for the inner core, and an outer layer of tobacco and/or non-tobacco material coaxially surrounding the inner core and its wrapper, with a wrapper for the outer layer. The characteristics of the paper and tobacco rods are balanced to ensure a lower smoulder rate than in conventional cigarettes (less than 2 mm/min). Consequently a reduction in the amount of sidestream smoke produced per unit of time occurs during the inter puff period. However, the cigarette burns continuously in a conventional manner with a glowing coal, i.e. there is no part of the cigarette which is extinguished or extinguishes during puffing or smoulder.

Very recently, European Patent Application No. 0 380 324 disclosed a rod of smoking material wrapped in a wrapper and having extending coaxially therealong, over a great proportion of the rod length, a rod of activated carbon. The purpose of this rod, it is asserted, is to provide a clean-burning smoulder element which maintains free smoulder whilst the surrounding tobacco material extinguishes. As an alternative to the axial rod, a sheath wrapper also composed of activated carbon, can be used to enclose a conventional tobacco rod. The smoking material annulus or tobacco rod extinguishes in the inter-puff period and is re-ignited by the increased burning of the smoulder element due to the drawing in of oxygen when the cigarette is puffed upon. A drawback of this proposal is that the carbon element will have a disadvantageous effect on the mainstream carbon monoxide delivery. Also, it is to be expected that there would be an unacceptable carbon off-taste in the mainstream smoke delivered to the smoker. Furthermore, because of the fragile nature of the carbon rod, it may easily be broken during manufacture. The position of the carbon rod so that it cannot be seen by the smoker at the lighting end of the cigarette, in order to present a conventional rod end to the smoker, will also make for manufacturing difficulties.

It is an object of the present invention to provide alternative smoking article constructions without the disadvantages seen in the prior art documents, which constructions have the advantage of a reduced, or possibly negligible, inter-puff sidestream production, yet which can resume normal smoking characteristics when the article is drawn upon.

Cigarettes according to the present invention seek to use the tobacco material therein in a more effective manner, so that no tobacco or substantially less than the normal amount of tobacco is wasted in the inter-puff period.

SUMMARY OF THE INVENTION

One aspect of the present invention provides a smoking article comprising a rod of combustible material wrapped in a wrapper, which rod is provided with an inter-puff region capable of maintaining smoulder in the inter-puff period, and a puff region comprising tobacco-containing material, the inter-puff region being capable of re-igniting a further puff region spaced from the first puff region.

Another aspect of the present invention provides a smoking article comprising a rod of combustible material wrapped in a wrapper, which rod is provided with an inter-puff region capable of maintaining smoulder in the inter-puff period whilst adjacent smoking material is substantially extinguished, the region extending lengthwise of the rod of combustible material and being comprised of cut tobacco or tobacco-containing material, said region being capable of re-igniting the adjacent smoking material when the article is drawn upon in a puff.

The puff region may include material which is also present in the inter-puff region and may comprise the same material as the inter-puff region.

In the first aspect of the invention the inter-puff region may be comprised wholly of non-tobacco material such as binders, inorganic fillers, such as perlite or chalk, carbon or carbonised material, activated carbon, starch or modified starch, cellulose or modified cellulose, and chemical additives which decompose on heating to release oxygen and promote burning, or compounds which release volatile substances, flavourings, for example. Mixtures of all of these materials are also suitable for the inter-puff region. The non-tobacco material may, for example, be produced by an extrusion process.

Alternatively, in both the first aspect and, in particular, the second aspect of the invention, the inter-puff region may be comprised wholly of tobacco material, such as reconstituted tobacco material, tobacco powder, tobacco fines or cut tobacco leaf material (lamina and/or stem).

Such tobacco material may also be mixed with non-tobacco material such as described above to provide tobacco-containing filler material. The tobacco-containing inter-puff region may be an extrudate material extending lengthwise of the rod of combustible material. The extrudate material may suitably be a foamed extrudate material, preferably of an open cell structure to allow draw therealong.

The rod of combustible material in the first aspect of this invention may suitably comprise areas of high levels of tobacco material (puff region) adjacent areas of low levels of tobacco material (inter-puff region). In such instances, the rod of combustible material may have a segmented or bulbous appearance. Each segment having a high level of tobacco-containing material is suitably located adjacent to or close to a segment of a low level of tobacco-containing material. The distance between the segments of a high level of tobacco-containing materials is suitably equivalent to the duration of an inter-puff period. As used above, a 'high level' of tobacco material means from about 20%–100% by weight of the puff region is tobacco. The term 'a low level' of tobacco material means tobacco is present in the inter-puff region in an amount of 0% to 20% by weight of the material in the puff region.

Advantageously, such rods of high and low level tobacco-containing segments may be produced by the method of extruding a rod of a tobacco-containing formulation, the rod having the desired smoking article circumference, removing substantially annular portions of the rod to provide segments of a high level of tobacco material adjacent segments of a low level of tobacco material, and wrapping the thus produced rod in a wrapper. The extrudate may be extruded at the desired diameter or sized after extrusion to the desired diameter.

A thermal forming step can be used to remove the substantially annular portions of the rod. The rod is suitably rotated about its longitudinal axis as the thermal forming step occurs.

Alternatively, the segmented rod of the first aspect of the invention may be produced by assembling, in linear sequence, cut lengths or segments of a high level of tobacco-containing material and segments of a low level of tobacco-containing material and wrapping the thus formed rod in a wrapper. Advantageously, the segments are adhered one to another by means of a binder.

In yet another alternative of the first aspect of the invention, the rod of combustible material may comprise a fuse portion capable of sustaining smoulder in the inter-puff periods, the fuse portion extending lengthwise along the rod of combustible material. Disposed about the fuse portion and arranged in segments are tobacco-containing segments. Each tobacco-containing segment is adjoined to the previous segment by the fuse portion but is discretely spaced from adjacent segments.

The fuse portion of this first aspect of the invention is suitably comprised either of wholly non-tobacco combustible material, wholly tobacco material, or tobacco material and non-tobacco combustible material. The fuse portion should be capable of sustaining smoulder without contributing significantly to the sidestream smoke of the article. Suitable materials for a non-tobacco region have been outlined above. The fuse material may also be produced by an extrusion process to provide, for example, a foamed extruded rod of chalk, which may also comprise a proportion of carbon or perlite material. The extruded fuse portion may have a diameter within the range of about 1 mm to about 4 mm. The fuse portion may comprise one or more rods of fuse material.

In a further alternative of the present invention, the rod of combustible material is, advantageously, comprised of a coiled arrangement of a thread of tobacco-containing material. Suitably, the thread of tobacco-containing material is a rod-form extrudate material. In this embodiment, in situ the puff regions and inter-puff regions are visually indistinct from one another. In operation, the puff regions are laterally spaced from one another by means of a lengthwise extending, but not linearly coaxial, inter-puff region. This embodiment has features of both the first and second aspects of the invention as claimed.

Advantageously, in the second aspect of the invention, the inter-puff region capable of maintaining smoulder comprises a fuse portion which extends substantially along the full length of the rod of combustible material. The fuse portion may be comprised of one or more rods of fuse material, which rods of fuse material may suitably be equidistantly spaced. The fuse portion may extend axially of the rod of combustible material and may be arranged coaxially of said rod.

The fuse portion of the rod suitably has a diameter of from about 1 mm to about 4 mm. The fuse portion may be an extrudate material, which material preferably has a foamed structure and a low density.

The region capable of maintaining smoulder in the inter-puff period in this second aspect of the invention may also suitably comprise a proportion of carbonised material, carbon, activated carbon, inorganic fillers, such as perlite or chalk; binders, such as starch or modified starch, cellulose or modified cellulose; and chemical additives capable of releasing oxygen on heating to promote burning.

The fuse portion may be wrapped by a wrapper. The wrapper suitably has a permeability in the range of 5–200 Coresta Units. The surrounding or annulus material is suitably wrapped by a wrapper having a permeability of about 20 Coresta Units or less, preferably 10 Coresta Units or less and more preferably, 5 Coresta Units or less.

Suitably, the region capable of maintaining smoulder is so capable by virtue of the type of tobacco selected, i.e. the natural burn rate characteristics of the tobacco; the tobacco density or filling power, the presence of burn additive thereupon, the permeability of the wrapper surrounding either the core or the annulus, or both, or the composition of the combustible material thereof.

Suitably the fuse portion comprises cut tobacco material having a burn rate faster than the burn rate of cut tobacco surrounding said fuse portion, for example, said fuse portion may comprise Maryland or modified Virginia tobacco, surrounded by Oriental tobacco.

Factors affecting the extinguishing of the non-smoulder region include, for example, the type of tobacco therein and the permeability of the wrapper enclosing the non-smoulder region. A balance of the factors influencing smoulder and non-smoulder needs to be achieved.

Advantages of the present invention include the fact that due to the decreased burn rate of the rod there is a weight saving and consequent monetary saving to be had with the present invention, since a shorter rod can be provided which still provides the desired smoke delivery and number of puffs for the smoker. Even further, articles according to the present invention may be provided with a butt region which does not comprise tobacco, thus achieving a further reduction in un-used or uncombusted tobacco.

In the first aspect of the invention, in the inter-puff region there is usually little or no puff region material left to consume after the smoker has drawn on the rod. In contrast, in the second aspect of the invention, puff region material remains in close proximity to the inter-puff region material but is extinguished or substantially extinguished whilst the inter-puff region material smoulders.

BRIEF DESCRIPTION OF THE DRAWINGS

In order that the invention may be easily understood and readily carried into effect, reference will now be made to the accompanying diagrammatic drawings in which like numerals refer to like parts and in which.

DETAILED DESCRIPTION OF THE PREFERRED EMBODIMENTS

Figure 1:
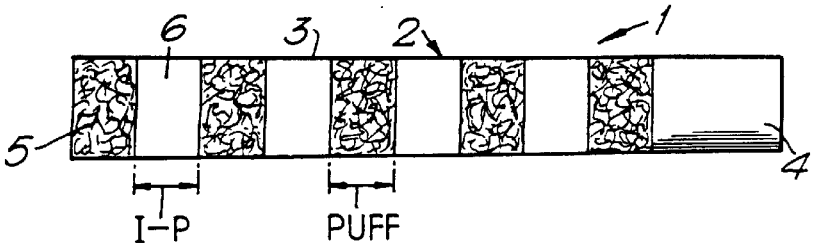
FIG. 1 shows a segmented smoking article in accordance with the first aspect of the present invention.

Where the reference numeral refers to similar, but not identical, objects the numeral is increased by 10 in each Figure.

FIG. 1 depicts a smoking article 1 according to the present invention. The smoking article 1 comprises a rod 2 of smoking material wrapped in a wrapper 3 and having a filter element 4 disposed at one end of the rod. The filter element 4 is optional.

The smoking article 1 has a segmented arrangement of alternating tobacco-containing pockets 5 and chalk and/or perlite-containing pockets 6. The pockets 6 may have additives applied thereto which promote burning.

The pockets may be comprised of sections of extruded material. Each section may be adhered together with a binder material. Apparatus similar to that described in U.K. Patent Specification No. 922,230 to prepare multiple filter elements may be used to produce this smoking material rod arrangement.

The dimensions of each pocket or section can be selected depending on the average inter-puff period and on the composition of each section, in particular the composition of the chalk/perlite mixture.

Figure 2:
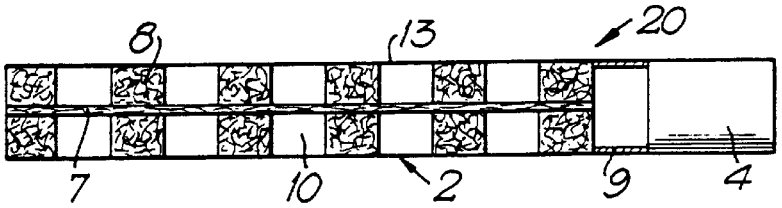
FIG. 2 shows a smoking article in accordance with the first aspect of the present invention and having a central fuse.

FIG. 2 depicts a smoking article having a central fuse element 7 along which are spaced pockets of tobacco material 8. The fuse element 7 comprises an extruded rod of tobacco, carbon and chalk or other inorganic material, in a formulation such as is described in U.K. Patent Specification No. 2 201 081 or European Patent Application 90306818.7 and produced as described in U.K. Patent Specification No. 2 201 080. The fuse element may also be non-tobacco containing. The article 2 may or may not be provided with a chamber 9 disposed between the filter element 4 and the downstream end of the rod 2. The wrapper 13 may be of a heavier paper or have an underlying wrapper beneath the wrapper 13 to add support to the annular spaces 10.

In operation, the fuse element 7 sustains smoulder in the inter-puff period without contributing significantly to side-stream smoke. Upon drawing on the smoking article 20 the burning of the fuse element is accelerated and, when the coal reaches the adjacent tobacco pocket, the increased burning causes the tobacco pocket to be ignited. The length of the fuse element or the burn rate thereof may be selected to equate with the average period between puffs. Similarly, the length of the tobacco pocket is selected to equate with the amount of tobacco consumed in an average puff length.

Figure 2A:
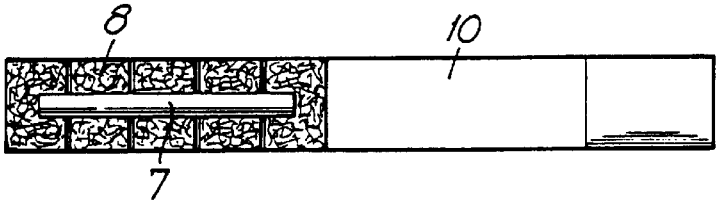
FIG. 2*a* shows a smoking article in accordance with the present invention and being a modification of the embodiment of FIG. 2.

A modification of this embodiment shown in FIG. 2*a* provides for the pockets of tobacco material 8 to be closely adjoining one another, yet remaining discretely separate from one another. The fuse element 7 extends within the tobacco pockets along the length of the smoking material rod body. The shorter tobacco length can thus be located at one end of the smoking article 20 with a single space 10 located between the tobacco material and the filter element 4.

Figure 3:
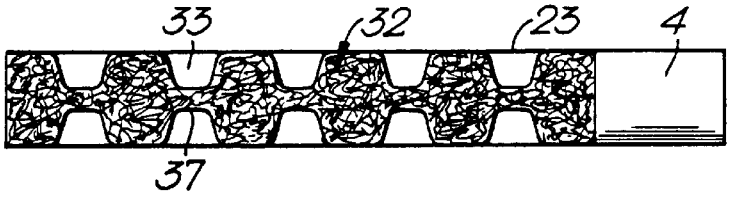
FIGS. 3 and 3*a* shows a smoking article and a modification thereof, both according to the first aspect of the present invention produced by thermal moulding of an extruded material.

FIG. 3 indicates an alternative embodiment which has a very similar effect to the embodiment depicted in FIG. 2, yet which is produced by an alternative method. The smoking material rod 32 comprises a body of extruded tobacco. The extrudate may be comprised of a formulation as described with respect to FIG. 2 and may be produced by the draw-down method of U.K. Patent Specification No. 2,201,080 to the required circumference. Thereafter, lengths of the extrudate are subjected to a thermal moulding procedure, such as that described in U.K. Patent Specification No. 1,507,765, to remove portions of the extrudate and to provide annular grooves 33 at predetermined locations along the extrudate length.

If desired, the walls of the annular grooves 33 may be sealed with a combustible binder, a hydroxymethylcellulose binder for example. A suitable sealing process is described in U.K. Patent Specification No. 2,033,207B.

The wrapper 23 may be of a heavier paper as described with reference to FIG. 2. The necks 37 of the annular grooves 33 may be coated, in accordance with the sealing process mentioned above, with burn retardant, burn promoter or carbon-containing paste, for example, to ensure that smoulder persists in the inter-puff period. The choice of burn retardant or burn promoter will depend on the composition of the extrudate. If the extrudate is carbon-containing or includes burn promoters therein, external coating of the necks 37 may not be required.

Figure 3A:
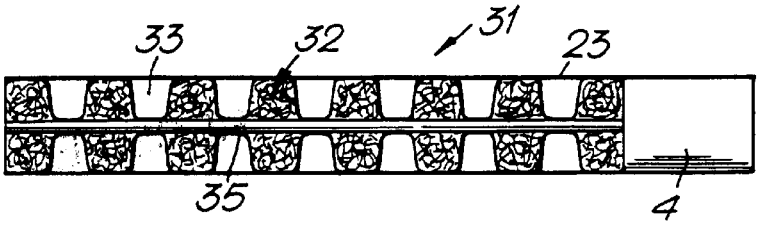

FIG. 3*a* depicts a further embodiment which operates in substantially the same manner as those embodiments depicted in FIGS. 2 and 3. In view of the similarity to FIG. 3 the same reference numerals are used to denote like parts. The mode of manufacture for this embodiment utilises co-extrusion procedures, whereby tobacco material is extruded around a co-extruded fuse 35 containing a smoulderable material, such as carbon, for example. The amount of carbon in the fuse 35 is selected to produce the minimum of off-taste in the mainstream smoke, yet still allow smoulder. The rod 31 is then thermally moulded, in the same manner as in FIG. 3, to provide annular grooves 33 at predetermined specific locations interdigitated between tobacco portions 32. The annular grooves 33 suitably extend to a depth sufficient to reveal or almost reveal the extruded carbon fuse 35.

Figure 4:
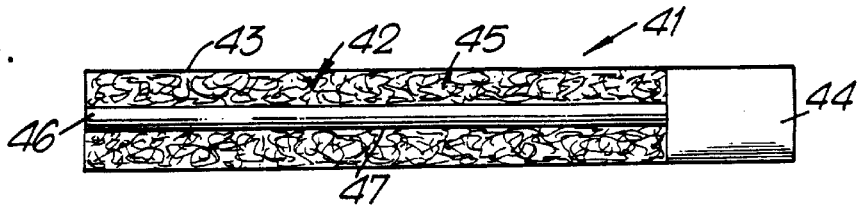
FIG. 4 shows an embodiment of a smoking article according to the second aspect of the present invention.

FIG. 4 depicts a smoking article 41 according to the second aspect of the present invention. The smoking article 41 comprises a rod 42 of smoking material wrapped in a wrapper 43. A filter element 44 is disposed at one end of the rod 42. The filter element 44 is optional.

The rod 42 comprises a body 45 of cut tobacco surrounding a fuse portion 46 of cut tobacco. The body 45 of tobacco is comprised of slow burning tobacco, such as, for example, Oriental tobacco. This Oriental tobacco may be treated with burn retardant compound(s). Suitable burn retardants would be known to those skilled in the art, for example, those materials described in our patent application published under the number GB 2 209 269A. The fuse portion 46 comprises fast burning tobacco, such as Maryland tobacco, for example, which may be further treated with burn promoting compounds, if necessary. Suitable burn promoters would be known to those skilled in the art, such as oxygen releasing compounds, for example. The fuse portion 46 has a circumference of about 13mm and is wrapped in a paper wrapper 47. The permeability of wrapper 47 is suitably less than 200 Coresta Units, and preferably less than 150 Coresta Units. The wrapper 43 is a low permeability paper of less than about 20 Coresta Units permeability, preferably less than 10 Coresta Units and more preferably less than 5 Coresta Units.

In operation, when the article 41 is lit, both the fuse portion 46 and the body 45 of tobacco burn simultaneously. As draw on the article 41 ceases, the body 45 of tobacco ceases to smoulder and either extinguishes completely, or substantially extinguishes. The fuse portion 46 maintains smoulder and produces a small amount of sidestream smoke. Upon further draw on the article 41 by the smoker, the fuse portion 46 re-ignites the body 45 of tobacco.

The loading level of burn retardant or promoter required to achieve the desired result is readily discovered by one skilled in the art with simple experimentation.

An advantage which is noticeable with this particular arrangement is that, as well as the reduced sidestream production, there is no off-taste in the mainstream smoke, which is a feature associated with such prior proposed methods as described in U.S. 4,231,377.

A number of variations on this embodiment were experimented with and are described in the following examples. Examples 1–5 provide cigarettes exhibiting significant reductions in sidestream smoke whilst the cigarettes appear to be extinguished in the inter-puff period and which re-light on puffing of the cigarette.

Several batches of plain, i.e. non filter-tipped, cigarettes according to this embodiment were produced. All the cigarettes had an outer circumference of 24.75 mm and a fuse portion having a circumference of 13.5 mm. The smoking material rod length of the cigarettes was 59 mm. In cigarettes according to the second aspect of the invention there are a number of variables which can have an effect on the smoke characteristics, such as the type of tobacco in the annulus. portion and the type of tobacco in the fuse portion, the presence of a wrapper for the fuse portion, and the permeability of the inner and outer wrappers of the annulus portion and fuse portion respectively. The following cigarettes looked at some of these effects. All of the cigarettes were made to a substantially constant rod weight.

EXAMPLE 1

To identify the effect of introducing a fuse portion into a cigarette of a particular tobacco blend, Cigarettes 2 and Cigarettes 3 were produced.

Control Cigarettes 2 comprised a conventional structure, i.e. tobacco filler material wrapped in a single paper wrapper. The filler material comprised a mixture of Oriental tobacco with Maryland tobacco in a mix ratio of about 2.8 to 1.00 respectively, i.e. about 26% Maryland tobacco was present in the blend. The Maryland tobacco is faster burning than Oriental tobacco. The paper wrapper of Cigarettes 2 had a permeability of 1.2 Coresta Units, a basis weight of 24.8 g/m$^2$, 0.7% chalk filler and 0.76% titanium dioxide.

Cigarettes 3 were produced with a fuse portion and an annulus portion. The filler material for both the fuse portion and the annulus portion ban identical to that of Cigarettes 2, i.e. the mixture of Oriental and Maryland tobacco in the ratio described above. The outer wrapper for Cigarettes 3 was the same as the single wrapper of Cigarettes 2. The inner wrapper for the fuse portion comprised a paper having a permeability of 112 Coresta Units, 24% chalk filler, a basis weight of 27.0 g/m$^2$ with 1.03% tri-potassium, tri-sodium citrate.

These cigarettes were smoked under standard machine smoking conditions, i.e. a 35 cm$^3$ puff of 20 mm using the fishtail chimney apparatus described in Analyst, October 1988, Vol. 113 in a paper entitled 'Evaluation of an Apparatus Designed for the Collection of Sidestream Tobacco Smoke'. The results are given below in Table 1.

Separating the smoking material rod into an annulus portion and a fuse portion by introducing a paper wrapped fuse portion within the smoking material rod has the following effects.

The puff number of Cigarettes 3 is reduced over Cigarettes 2.

An increase in mainstream smoke TNA and PMWNF yields is seen and there is a slight increase in the mainstream smoke nicotine to tar ratio. There is a reduction of about 16% in both the sidestream smoke TNA and PMWNF.

There is a significant increase (31.5%) in the TNA yield per puff which is a particularly useful feature to a cigarette designer.

The sidestream, PMWNF delivery per inter-puff period of Cigarettes 2 was 1.19 mg. The sidestream PMWNF delivery per inter-puff period of Cigarettes 3 was 1.17 mg. There is thus little difference in sidestream PMWNF delivery per inter-puff period for Cigarettes 3 compared with the control cigarettes, Cigarettes 2, i.e. merely forming a fuse portion and an annulus portion with the same tobacco blend in each does not appear to significantly affect the smoking characteristics of a cigarette.

It was noted that the pressure drop of Cigarettes 2 was 64.4 mm W.G. and that of Cigarettes 3 was 81.7 mm W.G.

TABLE 1

| CIGARETTE | PUFF NO. | MAINSTREAM (mg) TNA | MAINSTREAM (mg) PMWNF | SIDESTREAM (mg) TNA | SIDESTREAM (mg) PMWNF | SIDESTREAM (mg) CO | SIDESTREAM (mg) $CO_2$ |
|---|---|---|---|---|---|---|---|
| 2 | 14.2 | 1.02 | 27.20 | 1.17 | 16.66 | 24.3 | 243 |
| 3 | 12.5 | 1.18 | 29.55 | 0.98 | 14.06 | 25.6 | 237 |
| | (11.97%) | (15.7%) | (8.64%) | (16.2%) | (15.6%) | (5.3%) | (2.47%) |

The figures in brackets represent percentage increases or decreases in yield of Cigarettes 3 over Cigarettes 2.

EXAMPLE 2

Another set of cigarettes, Cigarettes 4, were produced in which the fuse portion of the cigarette comprised solely the Maryland tobacco seen in Example 1 and the annulus portion comprised solely the Oriental tobacco seen in Example 1. The paper wrapper for the annulus portion was that paper used as the outer wrapper for Cigarettes 2 and 3. The paper wrapper for the fuse portion was that paper used as the inner wrapper for Cigarettes 3. Thus, the cigarette comprised a slow burning annulus surrounding a faster burning fuse portion.

If Cigarettes 4 are compared with control Cigarettes 2 as in Table 2 it can be seen that separating a mixed tobacco blend into a cigarette comprising the faster burning tobacco in the core and the slower burning tobacco in the annulus results in a significant increase in the puff number of the cigarettes.

In view of the increase in puff number the puff-by-puff mainstream smoke deliveries of Cigarettes 4 are only very slightly lower than those of Cigarette 2, despite the increase in actual mainstream smoke deliveries of TNA and PMWNF.

The actual sidestream smoke yields are decreased. The effect of this actual decrease in sidestream smoke yields, combined with the increase in puff number overall, is significant. In Cigarettes 4, the PMWNF/smoulder period delivery, or sidestream PMWNF delivery per inter-puff period, is 0.92 mg. In Cigarettes 2 the PMWNF/smoulder period is 1.19 mg. This represents a 23% reduction in PMWNF delivery/smoulder period for Cigarettes 4 over control cigarettes, Cigarettes 2.

It was noted that the pressure drop of Cigarettes 4 was 62.7 mm W.G.

EXAMPLE 3

Cigarettes 5 were produced which comprised a fuse portion of a modified Virginia (faster burning) tobacco surrounded by Oriental (slower burning) tobacco. The wrapper for the fuse portion was identical to the wrapper of the fuse portion of Cigarettes 3 and 4. The wrapper for the annulus portion was identical to the outer wrappers of Cigarettes 2 to 4. The results of smoking these cigarettes are given in Table 3 below and are compared with Cigarettes 4 to see the effect of modifying the fuse material alone.

The PMWNF/smoulder period for Cigarettes 5 is 1.07 mg. The PMWNF/smoulder period for Cigarettes 4 is 0.92 mg.

Unfortunately, no control cigarette was prepared of a conventional cigarette structure, i.e. without a fuse, and having as the tobacco filler a mixture of Virginia and Oriental tobaccos. It is to be expected that the PMWNF/smoulder period of Cigarette 5 would be less than the PMWNF/smoulder period of such control cigarettes, if prepared.

This Example shows that the modified fuse of Virginia and Oriental tobaccos is not as effective at reducing PMWNF/smoulder period as the Maryland and Oriental tobaccos.

It was noted that the pressure drop of Cigarettes 5 was 60.0 mm W.G.

TABLE 2

| CIGARETTE | PUFF NO. | MAINSTREAM (mg) TNA | MAINSTREAM (mg) PMWNF | SIDESTREAM (mg) TNA | SIDESTREAM (mg) PMWNF | SIDESTREAM (mg) CO | SIDESTREAM (mg) $CO_2$ |
|---|---|---|---|---|---|---|---|
| 2 | 14.2 | 1.02 | 27.20 | 1.17 | 16.66 | 24.3 | 243 |
| 4 | 18.2 | 1.15 | 29.34 | 0.95 | 16.51 | 23.1 | 252 |
| | (28.17%) | (12.75%) | (7.87%) | (18.8%) | (0.90%) | (4.94%) | (3.70%) |

Figures in brackets are percentage increases or decreases in yield of Cigarettes 4 over Cigarettes 2.

TABLE 3

| | | MAINSTREAM (mg) | | SIDESTREAM (mg) | | | |
|---|---|---|---|---|---|---|---|
| CIGARETTE | PUFF NO. | TNA | PMWNF | TNA | PMWNF | CO | $CO_2$ |
| 4 | 18.2 | 1.15 | 29.34 | 0.95 | 16.51 | 23.1 | 252 |
| 5 | 15.8 | 1.37 | 35.52 | 0.93 | 16.10 | 21.4 | 233 |
| | | (19%) | (21%) | (2%) | (2%) | (7%) | (8%) |

Figures in brackets are percentage increases or decreases in yield of Cigarettes 5 over Cigarettes 4.

From the Examples illustrated above it can be seen that the presence of a faster burning tobacco in the fuse portion of a rod, rather than mixed homogeneously with slower burning tobacco in a non-fuse rod, produces substantially the same amount of sidestream smoke for the same tobacco weight but the delivery is spread over a longer time and a greater number of puffs, whereby the rate of production of sidestream in the inter-puff period is lower than would be seen in a non-fuse rod comprising homogeneously mixed slow and faster burning tobaccos.

Figure 5:
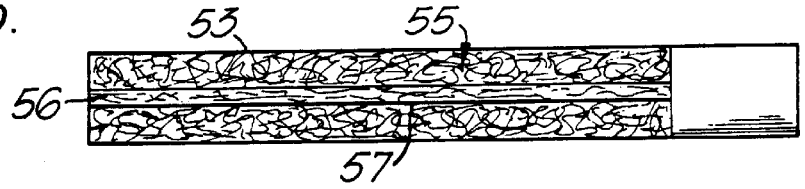
FIG. 5 shows another embodiment of a smoking article according to the second aspect of the present invention.

FIG. 5 depicts another arrangement which utilises the principle of the invention. It has been found that the density of the tobacco material is important in determining whether a tobacco rod can sustain smoulder.

The density of the tobacco body 55 and fuse portion 56 are arranged so that the fuse portion 56 smoulders whilst the tobacco body 55 extinguishes, either completely or substantially. The actual rod densities utilised will depend on the type of tobacco used and the burn rates of the tobacco in conjunction with the paper permeability of the wrappers 53 and 57.

A further unillustrated embodiment is of a similar arrangement to that shown in FIG. 5 but which utilises the same tobacco in the core and annulus. The tobacco is, however, treated with burn additives in amounts so that the core is kept smouldering by means of the addition of burn promoters, not necessarily by means of a particular rod density.

Figure 6:
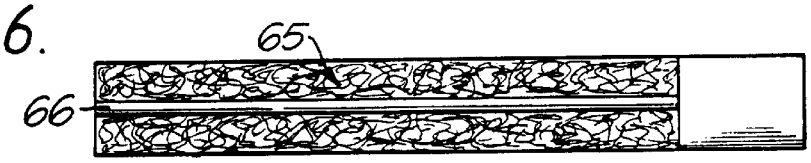
FIGS. 6 and 6*a* show another smoking article in accordance with the second aspect of the present invention in axial cross-section and transverse cross-section respectively.
Figure 6A:
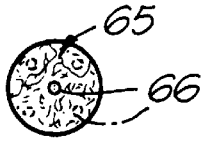

The embodiment shown in FIG. 6 is similar to that in FIG. 5. The annulus 65 comprises cut tobacco. The fuse 66, which may or may not be wrapped, comprises an extruded tobacco-containing mixture of a formulation such as that described in relation to FIG. 2 above. The fuse 66 may be comprised of an extruded drawn down rod or a rod of cut, extruded material. The extrudate, whether in drawn down rod-form or cut sheet-extruded tobacco, may also comprise carbon or other heat sink materials, and/or chalk, for example. The extruded fuse material 66 has a diameter of about 2 mm, seen in cross-section in FIG. 6*a*. The fuse 66 may have any position within the rod cross-sectional area. One or more fuses may be provided; such are indicated by dotted lines in FIG. 6*a*. Such an arrangement would also be suitable for the modification described in relation to FIG. 2, in which the fuse is a non-tobacco material. This embodiment operates in a similar manner as that of FIG. 5.

Figure 7:
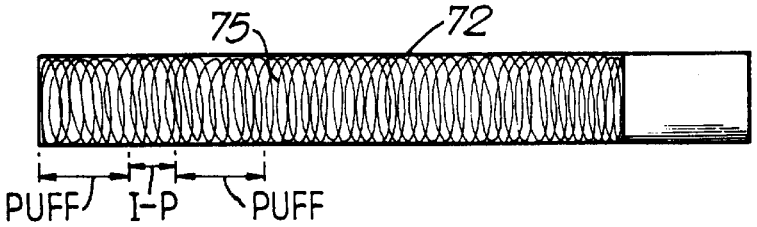
FIG. 7 shows yet another smoking article according to the first aspect of the present invention.

Finally, FIG. 7 depicts a smoking article which has a rod 72 comprising thin thread(s) 75 of tobacco extrudate, for example. The thread 75 is extruded and collected in a substantially coiled form, each coil being adjacent another coil. The nature of the thread material is arranged to be such that during smouldering burning proceeds along the thread itself. The distance between coils is such that when the article is drawn upon there is a transfer of heat from adjacent coils with the addition of drawn-in oxygen so that burning proceeds along a face perpendicular to the length of the rod, i.e. in a normal fashion.

The coil may be arranged around an inner core of combustible material, which also re-ignites during the puff. Alternatively, a low combustible and/or low density tobacco annulus may surround the coiled core. The coiled core in this case could be wrapped and fed through a garniture with the annulus material as described in our U.K. Patent Specification No. 2 170 692B.

The contents of all of the U.K. Patent Specifications referred to in the description of the specific embodiments are incorporated herein by reference thereto.

It should be noted that where the term 'tobacco' is used in this description there is embraced therein cut tobacco lamina and stem which may have been subject to either high or low order expansion processes, reconstituted tobacco material of cut sheet or rod-like form, extruded tobacco in cut sheet or rod-like form and mixtures with other combustible materials, the mixtures having a high proportion of tobacco material therein.

The smoking articles of this invention may also include oxygen-providing compounds which liberate oxygen upon heating as the coal approaches and assist in the re-igniting of the extinguished material.

Thermal imaging studies in respect of the embodiments described with reference to FIG. 4 have confirmed that the fuse portion is instrumental in maintaining smoulder in the inter-puff period and in re-igniting the annulus portion once puffing is resumed.

We claim:

1. A smoking article comprising a rod of combustible cut tobacco material wrapped in a wrapper, which rod is provided with an inter-puff region capable of maintaining smoulder in an inter-puff period of time between puffs whilst adjacent material is extinguished, the inter-puff region comprising a fuse portion which extends substantially along the full length of said rod of combustible material and being comprised of tobacco-containing material, said region being capable of re-igniting adjacent smoking material when the article is drawn upon in a puff.

2. A smoking article according to claim 1, wherein said fuse portion extends axially of said rod of combustible material.

3. A smoking article according to claim 1, wherein said fuse portion extends coaxially of said rod of combustible material.

4. A smoking article according to claim 1, wherein said inter-puff region is wrapped by a wrapper.

5. A smoking article acceding to claim 1, wherein the permeability of said wrapper is in the range of 5–200 Coresta Units.

6. A smoking article according to claim 1, wherein the smoking material rod is wrapped in a wrapper having a permeability of about 20 Coresta Units or less.

7. A smoking article according to claim 1, wherein the material in the puff region is substantially extinguished in the inter-puff period.

8. A smoking article according to claim 1, wherein said tobacco-containing material is extruded extrudate material.

9. A smoking article according to claim 8, wherein said extrudate has a cell structure which allows the extrudate to be drawn upon.

10. A smoking article according to claim 8, wherein said extrudate is cut, sheet extruded material.

11. A smoking article according to claim 8, wherein said rod of combustible material comprises a coiled arrangement of a thread of tobacco-containing material, said inter-puff region extending lengthwise but not linearly coaxially of said rod, and said material of said inter-puff region being the same as the material of said puff region.

12. A smoking article according to claim 1, wherein said tobacco-containing material is a reconstituted tobacco-containing material.

* * * * *

UNITED STATES PATENT AND TRADEMARK OFFICE

CERTIFICATE OF CORRECTION

PATENT NO. : 5,983,901
DATED : November 16, 1999
INVENTOR(S) : John Anthony Luke and Philip John Kinnard It is certified that error appears in the above-identified patent and that said Letters Patent is hereby corrected as shown below:

Title page,
Item [30], Foreign Application Priority Data, the date "February 9, 1990" should be changed to -- February 7, 1991 --.

Signed and Sealed this

Twenty-fourth Day of December, 2002

JAMES E. ROGAN
*Director of the United States Patent and Trademark Office*